United States Patent [19]

Anderson et al.

[11] 4,006,834

[45] Feb. 8, 1977

[54] TILT LINKAGE FOR LOADER BUCKETS

[75] Inventors: Reynold M. Anderson, Morton; Donald E. Tullar, Metamora, both of Ill.

[73] Assignee: Caterpillar Tractor Co., Peoria, Ill.

[22] Filed: Jan. 15, 1976

[21] Appl. No.: 649,310

[52] U.S. Cl. ..... 214/776; 214/140

[51] Int. Cl.[2] ..... E02F 3/82

[58] Field of Search ..... 214/131 R, 131 A, 140, 214/769, 773, 775, 776

[56] References Cited

UNITED STATES PATENTS

| | | | |
|---|---|---|---|
| 3,105,603 | 10/1963 | Beyerstedt et al. | 214/776 X |
| 3,246,778 | 4/1966 | Kampert et al. | 214/140 |
| 3,884,378 | 5/1975 | Muellner et al. | 214/769 |

FOREIGN PATENTS OR APPLICATIONS

| | | |
|---|---|---|
| 941,902 | 11/1963 | United Kingdom |

OTHER PUBLICATIONS

Sherman Front End Leader Advertisement, Sherman Products, Inc., Royal Oak Michigan.

*Primary Examiner*—L. J. Paperner
*Attorney, Agent, or Firm*—Phillips, Moore, Weissenberger, Lempio & Majestic

[57] ABSTRACT

A loader comprises a tractor having a pair of laterally spaced lift arms pivotally mounted thereon and a loader bucket pivotally mounted on forward ends of the lift arms. A cross brace is secured between the lift arms and has at least one bellcrank of a tilt linkage pivotally mounted intermediate its ends on lugs secured rearwardly on the cross-brace. The tilt linkage further comprises a double-acting hydraulic cylinder pivotally interconnected between the tractor and an upper end of the bellcrank and a link pivotally interconnected between a lower end of the bellcrank and the loader bucket. Upon actuation of the cylinder during operation of the loader, compressive stress will be imposed on the lugs and their metal common with the cross-brace and tensile stress will be imposed on the opposite surface of the cross-brace which is free of section changes that are stress concentrators. The absence of stress concentrators in this high tensile stressed surface reduces fatigue failure potential.

11 Claims, 3 Drawing Figures

10
11
12
13
14
15
16
17
18
19
20
21
22
23
24
25
26
27
28
29
30
31
L
D
II
II

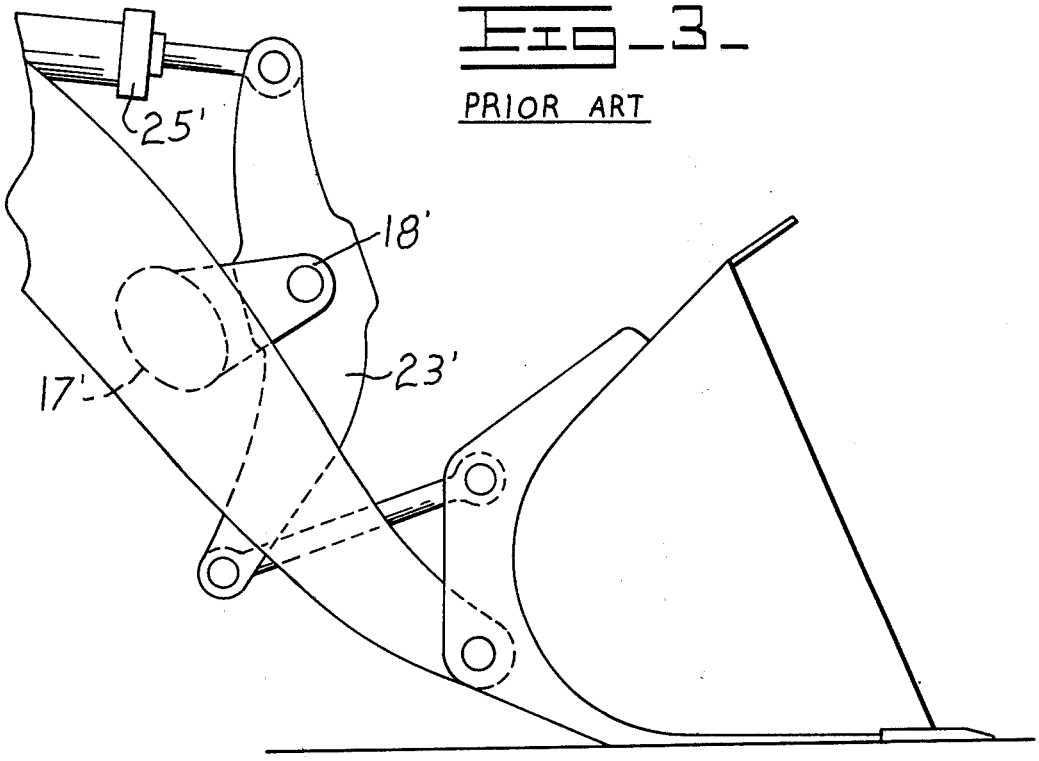
Fig-3-
PRIOR ART
Fig-2-
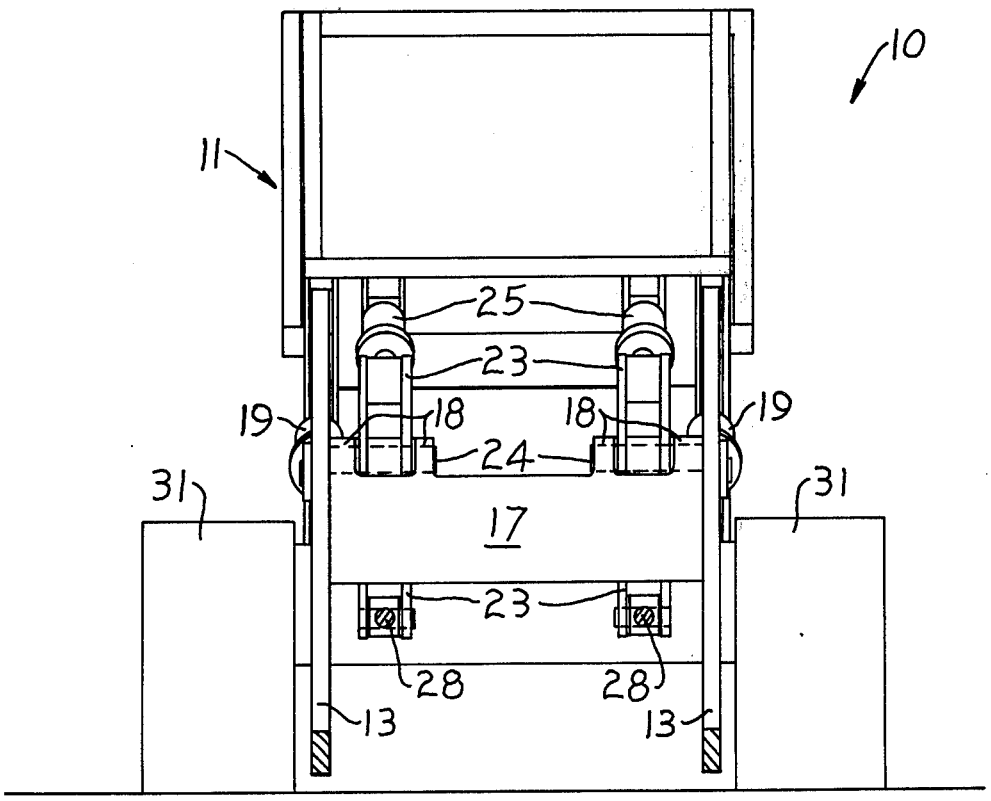

TILT LINKAGE FOR LOADER BUCKETS

BACKGROUND OF THE INVENTION

A conventional loader normally comprises a pair of lift arms having rearward ends thereof pivotally mounted on a tractor and a loader bucket pivotally mounted on the forward ends of the lift arms. A lift cylinder is pivotally interconnected between each of the lift arms and the tractor to selectively raise and lower the lift arms whereas a tilt linkage is pivotally interconnected between the lift arms and loader bucket to selectively pivot the loader bucket on the lift arms.

One type of conventional tilt linkage is the so-called Z-bar tilt linkage, illustrated in FIG. 3 of the drawings herein and more fully disclosed in U.S. Pat. No. 3,884,378, assigned to the assignee of this application. Such linkage comprises a bellcrank pivotally connected intermediate its ends to a cross-brace secured between the lift arms with attendant linkages being pivotally interconnected between the bellcrank and the tractor and the bellcrank and the bucket. The upper linkage normally constitutes a double-acting hydraulic cylinder whereby selective extension and retraction thereof will pivot the bucket on the lift arms.

One of the problems encountered with the latter type of Z-bar tilt linkage is that the bellcrank mounting lugs are placed in tension upon actuation of the tilt cylinder to thus unduly stress the cross-brace during various loading operations. In addition, the disposition of the tilt linkage on the lift arms tends to impair the workman's visibility, forwardly of the loader. Also, portions of the lift cylinders are disposed below the upper level of the tracks of the loader (track-type) to subject them to potential damage.

SUMMARY OF THIS INVENTION

An object of this invention is to provide an improved tilt linkage of the type described above which is adapted to place bellcrank mounting lugs on a cross-brace, secured between a pair of laterally spaced lift arms and having the linkage pivotally connected thereto, in compression during operation of a construction vehicle, such as a track-type loader. The rearward ends of the lift arms are pivotally mounted on a frame of the vehicle whereas a work tool, such as a loader bucket, is pivotally mounted on the forward ends thereof. A lift cylinder means is pivotally interconnected between at least one of the lift arms and the frame of the tractor for selectively raising or lowering the same. The tilt linkage means comprises a bellcrank means pivotally mounted intermediate upper and lower ends thereof on the above-mentioned lugs, rearwardly on the cross-brace, at a location disposed between the cross-brace and the rearward ends of the lift arms. Such an arrangement is thus adapted to place the mounting lugs on the cross-brace in compression upon pivoting of the work tool on the lift arms during vehicle operation.

BRIEF DESCRIPTION OF THE DRAWINGS

FIG. 2 is a front elevational view of the loader, taken in the direction of arrows II—II in FIG. 1; and FIG. 3 is a partial side elevational view of a conventional tilt linkage, illustrated for comparison purposes.

DETAILED DESCRIPTION

Figure 1:
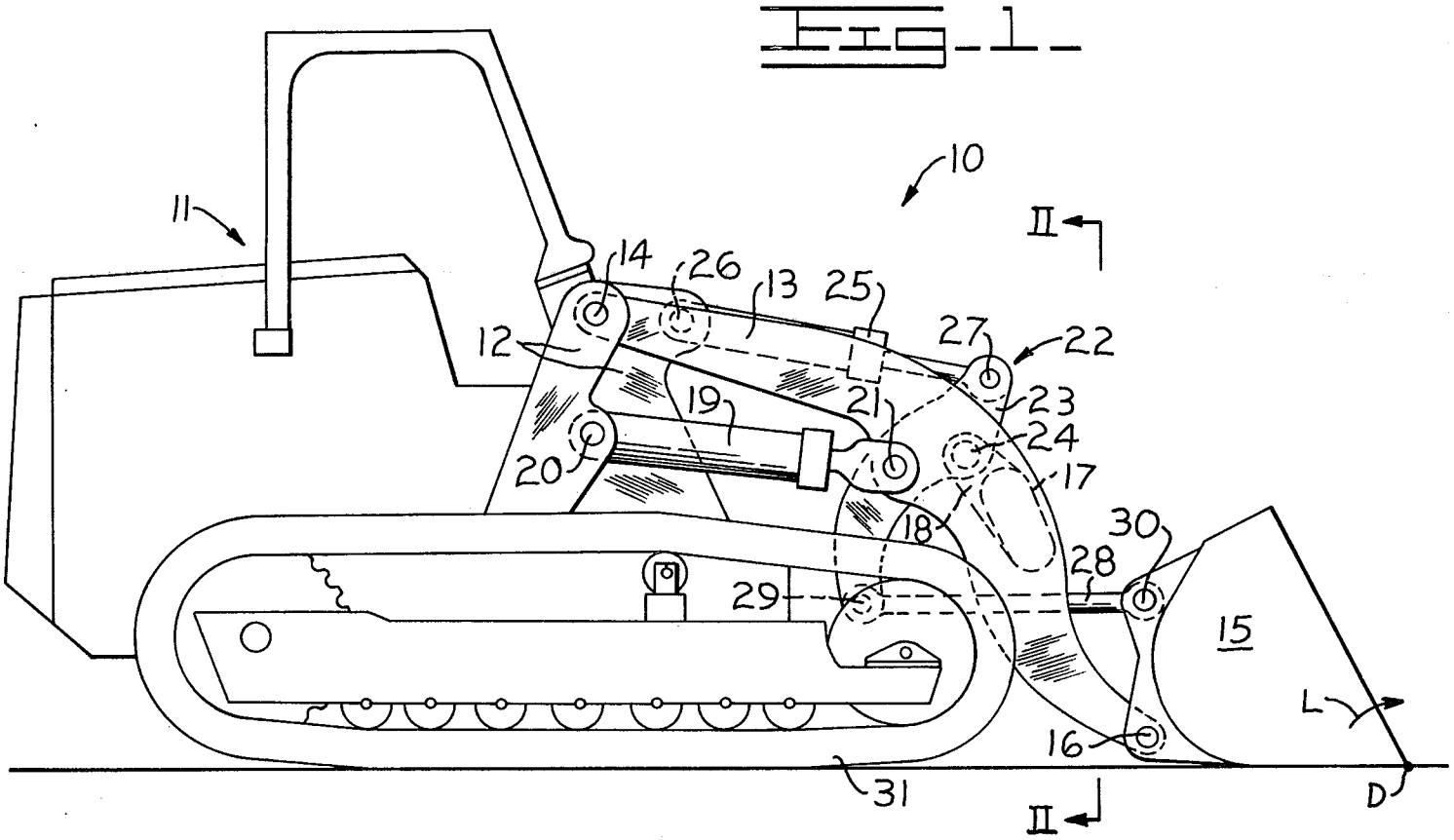
FIG. 1 is a side elevational view of a track-type loader having the tilt linkage of this invention employed thereon.

FIG. 1 illustrates a track-type loader 10 comprising a tractor 11 having a frame 12. The rearward ends of a pair of laterally spaced lift arms 13 are each pivotlly mounted on the frame by a pivot pin 14. Each lift arm is generally S-shaped to extend forwardly and downwardly relative to the tractor and has a work tool, preferably in the form of a loader bucket 15, pivotally mounted on a forward end thereof by a pivot pin 16.

As more clearly shown in FIG. 2, a cross-brace 17 extends laterally between the push arms and is suitably secured thereto by welds or the like. The cross-brace is disposed between the forward and rearward ends of the push arms and has a pair of bifurcated mounting lugs 18 secured thereto and each disposed adjacent to a respective one of the lift arms. The lift arms may be selectively raised or lowered vertically by lift cylinder means preferably comprising a pair of double-acting hydraulic cylinder 19 each pivotally interconnected between frame 12 of the tractor and a lower side of a respective lift arm by pivot pins 20 and 21, respectively.

A tilt linkage means 22 is pivotally interconnected between frame 12, cross-brace 17 and loader bucket 15 for selectively pivoting the loader bucket on the lift arms. The tilt linkage means comprises a pair of identical tilt linkages, the components of which are depicted by identical numerals. In particular, each tilt linkage comprises a bellcrank 23 pivotally mounted adjacent to a respective lift arm and intermediate upper and lower ends thereof on a respective pair of mounting lugs 18 by a pivot pin 24.

As shown in FIG. 1, the lugs and pivot pin are mounted rearwardly on cross-brace 17 and are disposed between the cross-brace and the rearward ends of the lift arms. Each tilt linkage further comprises a double-acting hydraulic cylinder 25 pivotally interconnected between frame 12 of the tractor and an upper end of bellcrank 23 by pivot pins 26 and 27, respectively. It should be noted that the cylinders are substantially confined vertically within the lift arms when the bucket is in its lowered position. The tilt linkage further comprises a link 28 pivotally interconnected between the lower end of bellcrank 23 and a backside of bucket 15 by pivot pins 29 and 30, respectively.

During a loading cycle of vehicle operation, the cutting edge of the bucket will engage the ground to provide a fulcrum point P which tends to pivot the bucket thereabout in the direction of arrow L (FIG. 1). It can thus be seen that such movement of the bucket will tend to place links 28 in tension to impose compressive stress on lugs 18 and their metal common with cross-brace 17 via bellcranks 23. Simultaneously therewith, the opposite, forward surface of the cross-brace will have tensile stress imposed thereon and is face of section changes that are stress concentrators. The absence of stress concentrators in this high tensile stressed surface reduces fatigue failure potential. Upon extension of tilt cylinders 25 to position the loader bucket in a rack-back condition of operation, for example, compressive stress will likewise be imposed on lugs 18 via bellcranks 23.

Such imposition of compressive forces on the cross-brace may be contrasted with the construction and function of the prior art tilt linkage illustrated in FIG. 3. In particular, a corresponding pair of mounting lugs 18' on a cross-brace 17' will be placed in tension by a bellcrank 23' upon both extension and retraction of a tilt cylinder 25' during both the loading and rackback and carrying phases of loader operation. Thus, stress concentrators are created at the mounting lugs which could give rise to fatigue failure.

It should be further noted that the disposition of the various tilt linkatge components of this invention provides the operator with substantially unobstructed visibility during operation of the loader. Also, the disposition of lift cylinders 19 entirely above the upper levels of a pair of ground-engaging endless tracks 31 of tractor 11 aids in preventing damage thereto. Lift arms 13 are also disposed inboard of the tracks to further aid in preventing damage thereto and to facilitate the employment of track shoes having varying widths. Furthermore, the construction and arrangement of the integrated lift arm and tilt linkage components aids in providing the vehicle with enhanced stability and adapt them for ready servicing.

We claim:

1. A construction vehicle comprising a tractor having a frame, a pair of laterally spaced lift arms having rearward ends thereof pivotally mounted on said frame and having forward ends thereof extending forwardly of said tractor, a laterally extending cross-brace disposed between the forward and rearward ends of said push arms and secured therebetween, lift cylinder means pivotally interconnected between at least one of said lift arms and said frame for selectively raising or lowering said lift arms vertically, a work tool pivotally mounted on the forward ends of said lift arms, and tilt linkage means pivotally interconnected between said frame, said cross-brace and said work tool for selectively pivoting said work tool on said lift arms, said tilt linkage means comprising bellcrank means pivotally mounted intermediate upper and lower ends thereof rearwardly on said cross-brace at a location disposed between said cross-brace and the rearward ends of said lift arms whereby compressive stress will be imposed on said location and tensile stress will be imposed on an opposite, forward surface on said cross-brace from said location upon pivoting of said work tool on said lift arms during operation thereof.

2. The construction vehicle of claim 1 wherein said work tool constitutes a loader bucket.

3. The construction vehicle of claim 1 wherein said tractor comprises a pair of ground engaging endless tracks.

4. The construction vehicle of claim 3 wherein said lift cylinder means is disposed entirely above upper levels of said endless tracks.

5. The construction vehicle of claim 4 wherein said lift cylinder means constitutes a pair of laterally spaced double-acting hydraulic cylinders each pivotally interconnected between the frame of said tractor and a respective lift arm.

6. The construction vehicle of claim 1 wherein each of said lift arm is generally S-shaped to extend forwardly and downwardly relative to said tractor.

7. The construction vehicle of claim 1 wherein the bellcrank means of said tilt linkage means comprises a pair of bellcranks each pivotally mounted closely adjacent to a respective one of said lift arms.

8. The construction vehicle of claim 7 wherein said tilt linkage means further comprises a pair of double-acting hydraulic cylinders each pivotally interconnected between the frame of said tractor and an upper end of a respective one of said bellcranks.

9. The construction vehicle of claim 8 wherein said cylinders are at least substantially confined vertically within said lift arms when said lift arms are maintained in their lowered positions.

10. The construction vehicle of claim 8 wherein said tilt linkage means further comprises a pair of links each pivotally interconnected.

11. The construction vehicle of claim 1 wherein said bellcrank means is pivotally mounted at said location on a pair of lugs secured rearwardly on said cross-brace.

* * * * *